United States Patent [19]

Jung et al.

[11] 4,381,859

[45] May 3, 1983

[54] WEB LAYING METHOD AND APPARATUS

[75] Inventors: Rolf Jung, Waiblingen; Walter Wienen, Fellbach, both of Fed. Rep. of Germany

[73] Assignee: Krauss u. Reichert GmbH & Co. KG, Fellbach, Fed. Rep. of Germany

[21] Appl. No.: 191,822

[22] Filed: Sep. 26, 1980

[30] Foreign Application Priority Data

Mar. 14, 1980 [DE] Fed. Rep. of Germany ..... 3009748

[51] Int. Cl.[3] ..... B65H 29/46

[52] U.S. Cl. ..... 270/31

[58] Field of Search ..... 270/30-31; 100/80; 68/177-178; 83/925 CC; 8/152; 269/254 R, 254 D, 254 CS, 256

[56] References Cited

U.S. PATENT DOCUMENTS

| | | | |
|---|---|---|---|
| 2,659,597 | 11/1953 | Shaak | 270/31 |
| 2,761,675 | 9/1956 | Obedin | 270/31 |
| 2,924,450 | 2/1960 | Deichmann | 270/31 |
| 3,727,907 | 4/1973 | Martin | 270/31 |
| 3,870,291 | 3/1975 | Fonio | 270/31 |
| 4,183,514 | 1/1980 | Off | 270/31 |
| 4,262,893 | 4/1981 | Sgroi | 270/31 |

*Primary Examiner*—A. J. Heinz

*Attorney, Agent, or Firm*—Spencer & Kaye

[57] ABSTRACT

A web laying machine for laying a web in superposed layers on a laying table has a laying carriage traveling back and forth along the length of the laying table between first and second end positions, a web laying unit vertically displaceably mounted on the laying carriage and a web holding unit arranged at the first end position for immobilizing the web while the laying carriage moves from the first end position to the second end position. The web laying unit is maintained, during at least the greatest part of the travel of the laying carriage between the two end positions, at a laying height above the laying table. The laying height is at a higher level than the height position of the web laying unit while the laying carriage is in the first end position. Further, the web laying unit is lowered at least approximately to the level of the precedingly deposited web layer or, in the absence thereof, to the level of the laying table, at the latest when the laying carriage reaches the web holding unit.

16 Claims, 21 Drawing Figures

A
C

~166
~180/1
~180/2
~164/1
~164/2
~164/3
~164/4
148/1
148/2
$U_B$
$U_S$
d1
d2
d3
d4
d5
d6
d7
d8
d9
d11
d12
d13
310
312
314
316
320
~162
$U_A$
t

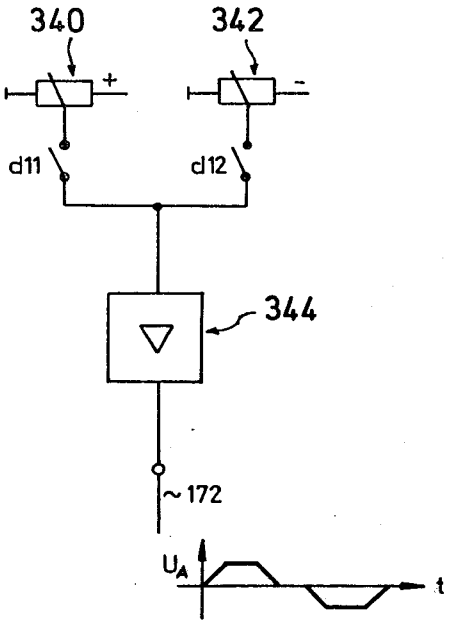
Fig. 16 C
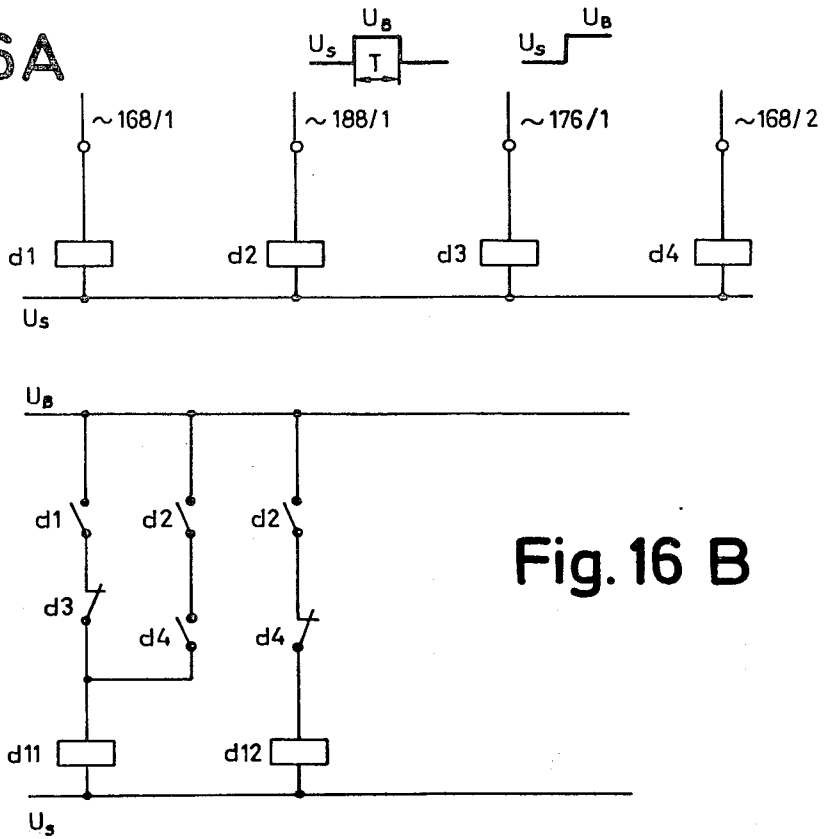
Fig. 16 A
Fig. 16 B

WEB LAYING METHOD AND APPARATUS

BACKGROUND OF THE INVENTION

This invention relates to machines for laying a web to form superpositioned web layers. By "web" there is meant a flexible sheet material which may be a fabric or other woven or non-woven material and which, as stock material, has a predetermined width and generally an indetermined length.

Web laying machines generally have an elongated laying table on which a laying carriage, propelled by a drive supported thereon, travels back and forth. The end positions (that is, the locations where the direction of travel of the laying carriage is reversed) are determined by means of limit switch assemblies which are adjustable in the longitudinal direction of the laying table. Conventionally, the laying carriage supports the web stock wound on a core and further, the laying carriage has a pulling device which can be connected to or disconnected from a drive by means of a switchable clutch. The pulling device comprises take-off rolls for pulling the web from the supply. Extending from the supply, the web passes through a web deflecting device (hereafter web laying unit) which is supported on the laying carriage and which is displaceable vertically with respect thereto. The web laying unit deflects the web approximately into a horizontal direction and deposits it on the laying table.

There are further known laying machines wherein the web stock is stored in a zigzag-folded stack and it is further feasible to arrange the supply stationarily apart from the laying carriage.

By means of the known web laying machines a web can be laid according to a number of processes. The simplest process is the so-called simple laying mode. In such a method, at one terminal position of the laying carriage there is provided a web holding unit for immobilizing the web lengths to be laid. The web holding unit usually comprises a web grasping rail. During the course of the laying operation, the laying carriage first travels up to the web grasping rail, then raises the same during approach in such a manner that the web grasping rail, upon reversal of the traveling direction of the laying carriage, comes to rest on that portion of the web which has just left the web laying unit and then the web grasping rail pulls the web onto the laying table and immobilizes it thereon, whereupon the laying carriage, during its travel towards its second, opposite terminal position, deposits a web layer onto the laying table. As the laying carriage stops in its second terminal position, a cutting device which is movable transversely to the laying table along the web laying unit, severs the deposited web layer from the web supply. Thereupon the laying carriage, without performing a laying operation, travels to the first terminal position, thus completing a cycle of the repetitive operation.

In the so-called zigzag laying mode, the laying carriage deposits web lengths on the laying table during travel in both directions. For this mode the laying machine has a web holding unit also at the location of the second terminal position of the laying carriage.

The known web laying machines and laying methods have a number of disadvantages. Thus, since particularly textile webs have the tendency to bulge along the edges of the web laid out on the laying table (in case of some materials the edge regions may bulge as much as 30 mm beyond the height of the web stack), the laying carriages of the known web laying machines move the web laying unit at a substantial height back and forth above the uppermost web layer. Consequently, as the laying carriage leaves the respective terminal position, the web grasping rail (or rails, as the case may be) pulls the web over a substantial vertical length onto the laying table or, as the case may be, onto the uppermost web layer. This, in turn, means that the deposited web is either not free from longitudinal stresses and therefore is not distortion free or the web pulling device of the laying carriage has to operate with a material excess, that is, it has to draw off more material from the supply than what would correspond to the path traveled by the laying carriage. Such an operation would again be inconsistent with the requirement for a planar and uniformly laid web layer.

SUMMARY OF THE INVENTION

It is an object of the invention to lay a web on a laying table such that the deposited web is in a uniform condition and at least approximately in a stress-free state.

This object and others to become apparent as the specification progresses, are accomplished by the invention, according to which, briefly stated, the web laying unit is maintained, during the greatest part of the travel of the laying carriage between the two end positions, at a greater height level above the laying table than when the laying carriage is in its first end position and further, the web laying unit is lowered at least approximately to the level of the previously deposited web layer or, in the absence thereof, to the level of the laying table, at the latest when the laying carriage has reached the web holding unit.

Thus, according to the principle of the invention, the web laying unit is, at least along the greatest part of the traveling path of the laying carriage, maintained at such a height above the web layers that any contact or collision with upwardly bulging web edges is securely prevented and further, the web laying unit is lowered to the level of the uppermost web layer at the latest when the laying carriage reaches that terminal position where a web holding unit is located. Thus, the web holding unit no longer needs to pull down the web—which leaves the web laying unit—from a substantial height onto the laying table or, as the case may be, onto the previously deposited web layer. Expediently, during the lowering, the web pulling device of the laying carriage is switched into an idling position; this, however, in contradistinction to known processes, is not a requirement because according to the process of the invention, the web zones adjoining a web end, as the laying carriage leaves one of its terminal positions and the web holding unit immobilizes the end of the web, travel through a path length—as viewed from the laying carriage—which corresponds at least approximately to and is, in any event, not appreciably greater than the length of travel path of the laying carriage.

According to a further feature of the invention, the web laying unit is raised only after the laying carriage has left the terminal position provided with the web holding unit and has traveled a certain distance, for example, 20 to 30 cm, because then no additional web length is needed for raising the web laying unit.

In order to save time, it is expedient to lower the web laying unit at a time when the laying carriage still moves towards the web holding unit; otherwise, if the lowering occurs while the laying carriage is already in its end position, additional time is required for lowering the web laying unit while the laying carriage is stationary.

In a web laying process in which the web layers are deposited only when the laying carriage moves from the first end position to the second end position and where the layers are severed in the second end position of the laying carriage, it is expedient to raise the web laying unit after the severing operation and before the laying carriage starts its motion in the direction of the first end position. In this manner it is securely avoided that the free end of the web layer just deposited is folded over by the web laying unit as the laying carriage performs its return travel. In such a case it is advantageous to lower again the web laying unit to the height of the uppermost layer at a short distance from the second end position.

In the zigzag web laying process, where in the second end position too, there is provided a web holding unit at the laying table and the web is being deposited in both directions of travel of the laying carriage, according to the invention the web laying unit is lowered onto the laying table or, as the case may be, onto the uppermost deposited layer at the latest when it reaches the second end position to ensure that the deposited web layers are maintained free from stresses also in the zone of the second end position.

In order to provide for an automatic process, the laying carriage of the web laying machine is, according to the invention, provided with height control switch arrangements which control the height position of the web laying unit. The height control arrangements include a sensor which determines the height of the web laying unit above the laying table or, as the case may be, above the uppermost deposited web layer and which is further responsive to a predetermined height value. The height control switch arrangements are activated by the limit switches. By means of a sensor as outlined above, one of the height positions of the web laying unit above the laying table or, as the case may be, above the web last-deposited web layer can be set with high precision. The web laying unit is moved into its second height position by means of another appropriate control, for example, a displacement pickup which controls the height of the web laying unit relative to the height position set by the sensor, and shuts off the lifting mechanism (winch) of the web laying unit. Or, as a simpler alternative, according to a further feature of the invention, a second height switching arrangement comprises a timer (timing relay) which determines the distance between the height set by the sensor and the other height position and accordingly shuts off the lifting mechanism.

It is feasible to determine the height position of the web laying unit above the laying table or, as the case may be, above the last-deposited web layer by sensing with mechanical contacting, it is, however, preferred to provide a sensor designed as a switch that senses without mechanical contacting. Such a sensor may be for example, a proximity switch known by itself which responds to a change of the dielectric constant of the environment. As a further alternative, light barriers may be used as sensors; these devices are adapted to practically all types of webs. Particularly reflected light-type optical barriers may find advantageous use: these devices emit a light beam downwardly and focus it in a location situated at a certain distance underneath the web laying unit and further, an optical lens arrangement coupled with a photocell is directed to this location so that the reflecting light sensor is actuated in case a web is present at that location (except when such web is, in the optical sense, perfectly black which does not occur in practice).

It is feasible to provide for each end position of the laying carriage, a single limit switch arrangement which de-energizes the drive of the laying carriage at a predetermined distance from the web holding unit and lowers the web laying unit so that the latter has reached its lowermost position at the time the laying carriage used up its momentum and reached its end position. Preferably, however, at least that limit switch arrangement which is associated with the web holding unit, has a first control element which becomes effective shortly before the laying carriage reaches the end position and a second control element which becomes effective upon reaching the end position and further, the height switching arrangement for lowering the web laying unit is actuated by the first control element, while the drive for the laying carriage is de-energized by the second control element. In such a system inertia properties of the laying carriage have practically no effect. Preferably, the first control element also serves for switching the drive of the laying carriage from a relatively high laying speed (hereafter high-speed run) to a crawling speed (hereafter low-speed run). Further, the first control element then also serves for raising again the web laying unit after the laying carriage has left its terminal position.

The known web laying machines have web holding units which comprise holding elements that are pivotal about a horizontal axis extending transversely to the length of the laying table. As the laying carriage enters into the end position associated with the web holding unit, the holding elements are positioned onto the web portion which leaves the web laying unit. As the laying carriage leaves the end position, the holding elements are lowered by pivoting about the above-noted axis from an obliquely oriented position into a horizontal position. Since during this occurrence the edge of the holding element which engages the uppermost web layer and which is oriented away from the laying carriage, moves relative to the laying carriage in a direction which is opposite to that of the traveling direction of the laying carriage, in the known laying machines the holding elements cause a relative motion of the web layer with respect to the laying table. This is disadvantageous regarding the requirement for a stress-free laying of the web as well as an accurate superpositioning of the ends of the web layers. Therefore, according to a further feature of the invention, the web holding unit which has at least one holding element that presses the web layers downwardly, is so structured that the holding element can be positioned on the top of the web portion leaving the web laying unit and is pivotal at least approximately about its rear edge which is oriented away from the laying carriage and which can be positioned on the uppermost web layer. As a result, the above-noted rear edge does not shift in the longitudinal direction of the laying table when the holding element presses the new web portion (to be just deposited) against the laying table or, as the case may be, against the previously-deposited web layer. The feature to arrange the pivotal axis of the holding element in the zone of the rear edge ensures a more accurate alignment of the web ends.

BRIEF DESCRIPTION OF THE DRAWING

FIGS. 16A, 16B, and 16C show block diagrams of several portions of an embodiment of the height control unit shown in FIG. 7.

DESCRIPTION OF THE PREFERRED EMBODIMENT

Figure 1:
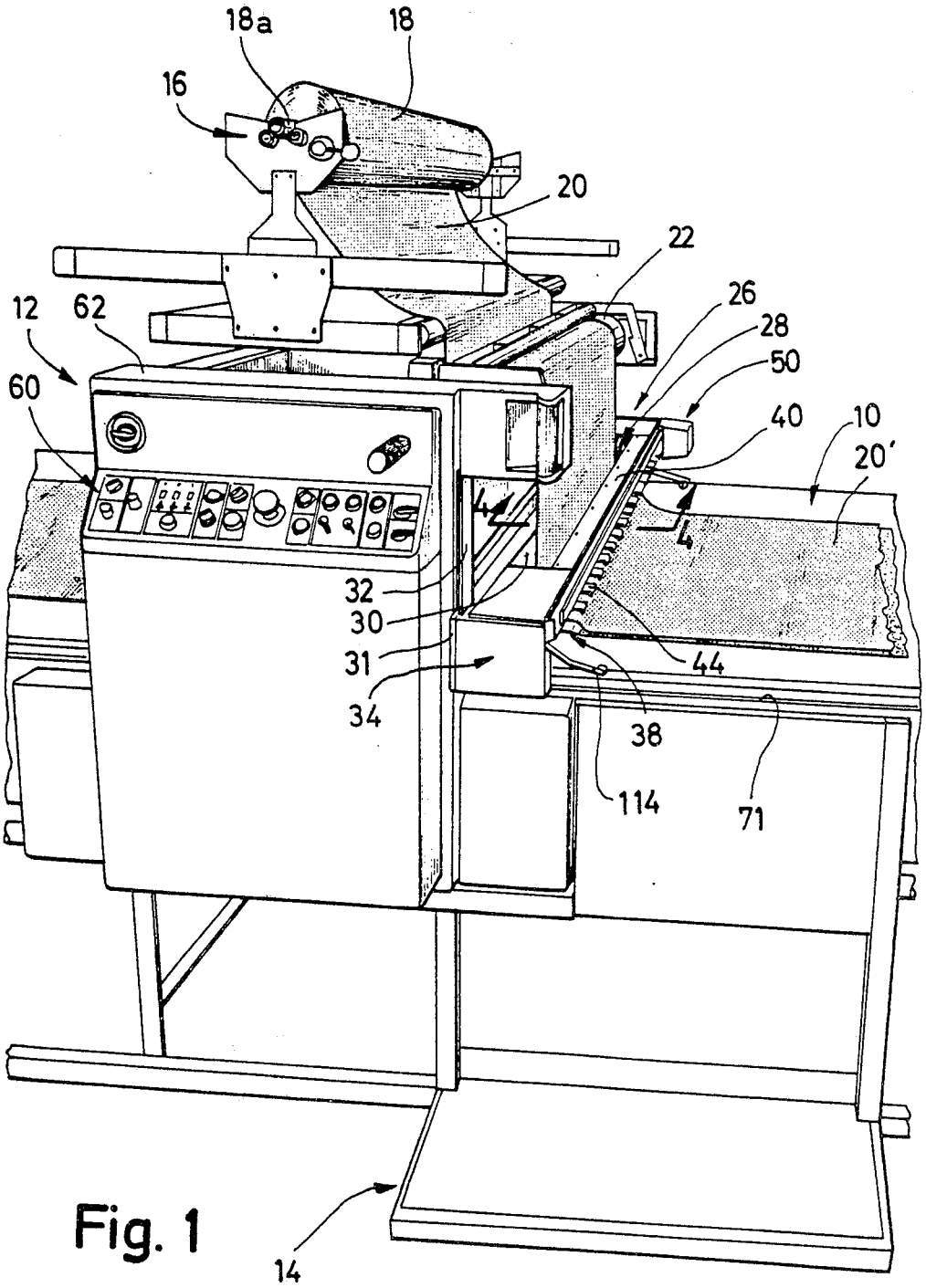
FIG. 1 is a perspective view of one part of a web laying machine incorporating a preferred embodiment of the invention.

Turning now to FIG. 1, there is shown a length portion of a laying table 10 and a laying carriage 12 including a traveling platform 14. The laying carriage 12 is, together with the traveling platform 14, propelled by a motor back and forth along the laying table 10. The laying carriage 12 is provided with bearing brackets 16 for supporting a shaft 18*a* for a supply reel 18 from which a web 20 can be pulled by means of a driven take-off roll 22.

Figures 2, 3:
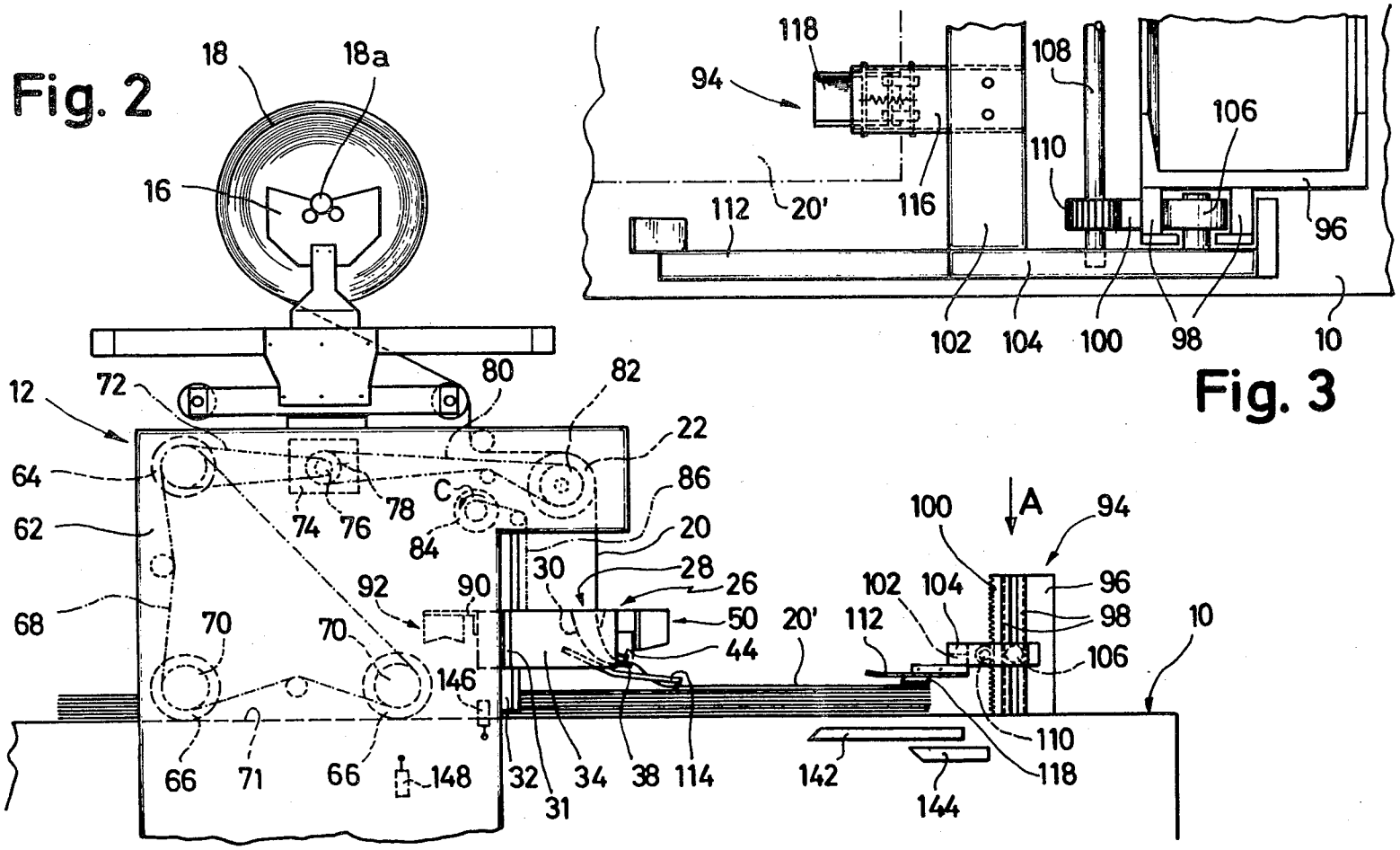
FIG. 2 is a schematic side elevational view of the preferred embodiment.
FIG. 3 is a top plan view of some of the components shown in FIG. 2, as seen in the direction of arrow A of FIG. 2.
Figure 4:
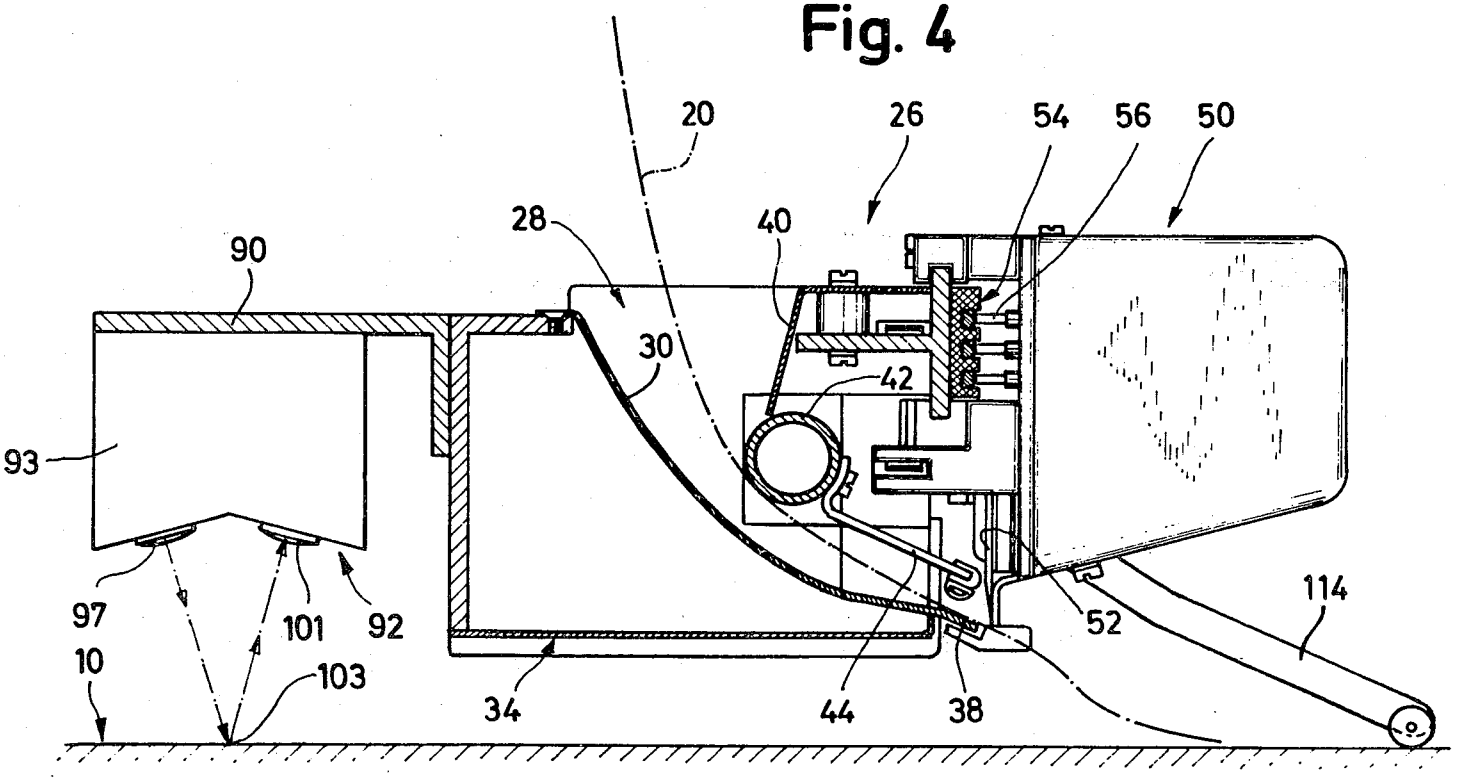
FIG. 4 is a sectional view taken along a vertical plane passing through line 4—4 of FIG. 1.

On the laying carriage 12 there is mounted a web laying unit 26 which can be raised and lowered vertically with respect to the laying table 10 as will be described in greater detail later. The web laying unit 26 has an upwardly open elongated funnel 28 which extends transversely to the length dimension of the laying table 10 and through which passes, from above, the web 20 advanced by the take-off roll 22. The web 20 is deflected by means to be discussed in greater detail in connection with FIG. 4 in such a manner that it leaves the web laying unit 26 parallel to the upper surface of the laying table 10 or at an acute angle with respect thereto. The web laying unit 26 has a box-shaped housing 34 extending transversely to the web laying direction, that is, transversely to the traveling direction of the laying carriage 12. The housing 34 is guided for vertical displacement with the aid of lateral guide shoes 31 cooperating with vertical guide rails 32 of the laying carriage 12. One wall of the funnel 28 is constituted by a guide face 30 which is bent in a shovel-shaped manner such that its lower guide face portion 38 which forms the outlet of the web laying unit 26 extends approximately in a horizontal direction. The other lateral wall of the funnel 28 is formed by an angled sheet metal member 40 which is secured to the housing 34. Underneath the angled member 40, in the housing 34 there is rotatably supported a carrier shaft 42 (FIG. 4). To the carrier shaft 42 there is secured a clamping strip 44 which, by means of an appropriate drive, such as an electromagnet (not illustrated), can be pivoted in such a manner that the clamping strip 44 presses the web 20 against the lower guide face part 38 when the web 20 is to be severed by means of a cutting unit 50 which is mounted on the web laying unit 26 and which travels back and forth transversely to the length dimension of the laying table 10. Again referring to FIG. 4, the cutting unit 50 comprises an electromotor (not shown) for driving a circular knife 52 and for propelling the cutting device along its above-noted transverse traveling path. The electromotor is supplied with current by means of a bus bar 54 and a current collector 56. During the laying operation, the clamping strip 44 assumes its position shown in FIG. 2.

Adjacent the traveling platform 14, the laying carriage 12 has a control panel 60 as well as a drive for propelling the laying carriage 12 back and forth. The carriage drive which is schematically illustrated in FIG. 2 and which is arranged between two side walls 62 situated at either side of the laying table 10, comprises in essence an electric motor 64, four runner wheels 66 (only two shown) arranged in pairs on either side of the laying table 10 as well as an endless chain 68 which meshes with a sprocket (not shown) mounted on the shaft of the drive motor 64 as well as two further sprockets 70 which are fixedly connected with the two runner wheels 66 oriented towards the observer of FIG. 2. The runner wheels 66 travel on rails 71 arranged on either side of the laying table 10. Thus, in this arrangement, since the transversely aligned running wheels 66 are not connected to one another by a shaft, only the running wheels 66 visible in FIG. 2 are driven wheels, whereas the two running wheels 66 which are arranged at the other, hidden side of the laying table 10 are idlers.

With the intermediary of a further sprocket (not shown) affixed to the shaft of the drive motor 64 and an endless chain 72, the drive motor 64 actuates a transmission gear 74 which is of known construction and which makes possible a stepless change of the transmission ratio between the input and output shaft of the drive gear 74. To the input shaft of the gear 74 there is secured a sprocket 76 which meshes with the chain 72, whereas to the output shaft of the gear 74 there is affixed a sprocket 78 which drives the take-off roll 22 by means of a chain 80 and a sprocket 82 secured to the shaft of the take-off roll 22. The drive motor 64 and the transmission gear 74 may be mounted on the inside of one of the lateral walls 62 of the laying carriage 12.

Further, the laying carrage 12 carries a reversible electric winch 84 which, when rotating in the direction of the arrow C, winds about its shaft a cable 86 from which the web laying unit 26 is suspended. Thus, when the winch 84 rotates in the direction of the arrow C, the web laying unit 26 is raised, whereas during rotation of the winch 84 in the opposite direction, the web laying unit 26 descends by its own weight.

To an arm 90 affixed to the web laying unit 26 and situated between the two lateral walls 62 of the laying carriage 12, there is secured a reflected light sensor 92 which, by itself, is a conventional apparatus whose structure and mode of operation will be discussed later. The purpose of the reflected light sensor 92 is to respond when the web laying unit 26 is at a previously determined vertical distance from the upper surface of the laying table 10 or, as the case may be, from the uppermost layer of the webs already deposited on the laying table 10. Such an uppermost layer is designated at 20' in FIGS. 1, 2 and 7.

Dependent upon the mode of operation of the web laying machine, at one or at both end positions of the laying carriage 12 there is arranged, on the laying table 10, a web holding unit 94 as illustrated in FIGS. 2 and 3. The web holding unit 94 comprises two uprights 96 which have a U-shaped cross section and which, in the zone of the two longitudinal edges of the laying table 10, are secured to the laying table in an appropriate manner. Each upright 96 is provided with two vertically extending parallel rails 98 spaced in the length dimension of the laying table 10. That rail 98 of each upright 96 which is the more remote from the adjacent longitudinal end of the laying table 10, carries, on its face oriented towards the laying carriage 12, a vertically extending toothed rack 100. Further, the web holding unit 94 has a web grasping rail 102 which extends transversely above the laying table 10 and the ends of which are secured to guide arms 104 which, in turn, carry runner rollers 106 situated between the rails 98. Further, the guide arms 104 rotatably support a shaft 108 which carries a pinion 110 meshing with the respective toothed rack 100 to ensure that the web grasping rail 102 always remains parallel to the upper face of the laying table 10 during the raising and lowering of the rail 102.

For controlling the web grasping rail 102, at the end thereof control arms 112 are secured which cooperate in such a manner with control arms 114 mounted on the web laying unit 26 that the obliquely outwardly and downwardly oriented control arms 114 move under the control arms 112 of the web grasping rail 102 when the laying carriage 12 has reached the vicinity of the web holding unit 94. This causes the web grasping rail 102 to be lifted. If, on the other hand, the laying carriage 12 moves away from the web holding unit 94, the web grasping rail 102 drops by its own weight.

To the web grasping rail 102 there are secured, at a transverse distance from one another, several carrier arms 116, to each of which a shoe-shaped or plate-shaped web holding element 118 is secured in a particular manner. Such a particular arrangement according to the invention may be best observed in FIGS. 5 and 6. Thus, the web holding elements 118 each have a U-shaped cross section with lateral faces 120 and a foot plate 122, on the underside of which there is secured a brush insert 124 for firmly grasping (immobilizing) the web to be laid. Further, each carrier 116 has an inverted U-shaped cross section with two lateral faces 126 in which a first shaft 128 is secured and in which slots 130 are provided for guiding a second shaft 132 which is mounted in the lateral faces 120 of the respective web holding element 118. On the shaft 128 there are pivotally mounted two levers 134 which are secured to a third shaft 136 rotatably supported in the lateral faces 120 of the web holding element 118. There is also provided a tension spring 138 which, with its ends, engages the shafts 128 and 132.

Figure 5:
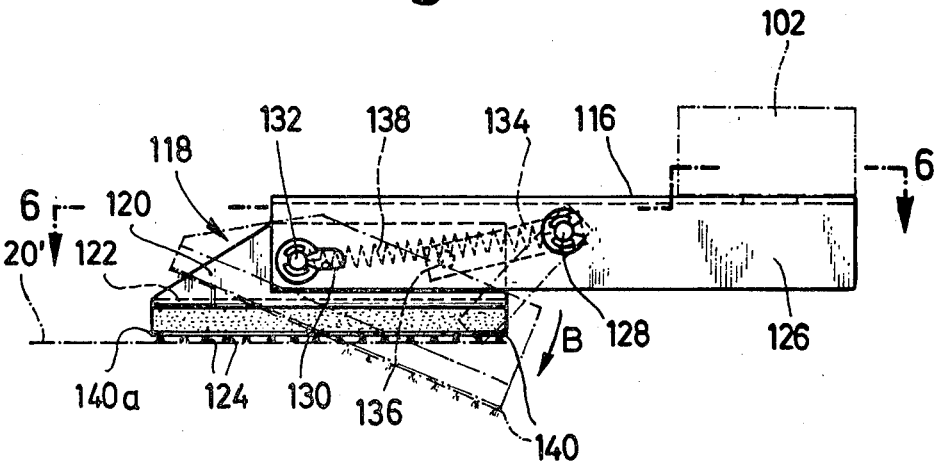
FIG. 5 is a side elevational view of a web holding component of the preferred embodiment.

As seen in FIG. 5, the tension spring 138 extends over the shaft 136, so that it pulls the shaft 132 towards the right (as viewed in FIG. 5) and pivots the web holding element 118—because of the lever 134 acting as a linkage—in a clockwise direction, that is, in the direction as indicated by the arrow B, until the shaft 132 abuts the right-hand ends of the slots 130 provided in the respective lateral faces 120. The geometry of this structure has thus been selected in such a manner according to the invention that upon lowering of the web grasping rail 102, the rear edge 140 of the underside of the web holding element 118 executes no relative motion in the longitudinal direction of the laying table 10 even if, during this occurrence, the web holding elements 118 are pivoted from the oblique, phantom-line position shown in FIGS. 5—in which the rear edge 140 of the underside of the web holding element 118 is lower than the front edge **140*a*—into the solid-line position in which the brush insert 24 extends parallel to the upper face of the laying table 10**.

Turning once again to FIG. 2, at one longitudinal side of the laying table 10 for each end position of the laying carriage 12 there are provided a first and a second control rail 142 and 144, respectively. The control rails 142 and 144 can be adjusted in the longitudinal direction of the laying table 10 and can be immobilized in a desired position. It is noted that FIG. 2 illustrates only the right-hand control rails which are oriented towards the illustrated web holding unit 94. It is to be understood that on the left-hand side (not illustrated in FIG. 2) of the laying table 10 there are provided two similarly-constructed control rails in such a manner that there is provided a control rail arrangement which is symmetrical to the path center of the laying carriage 12. The control rails 142 and 144 actuate two limit switches 146 and 148 respectively, which are arranged at the inside of one lateral wall 62 of the laying carriage 12. The limit switches 146 and 148 are actuated in a similar manner by the control rails arranged at the other, left end of the laying table 10.

Figure 7:
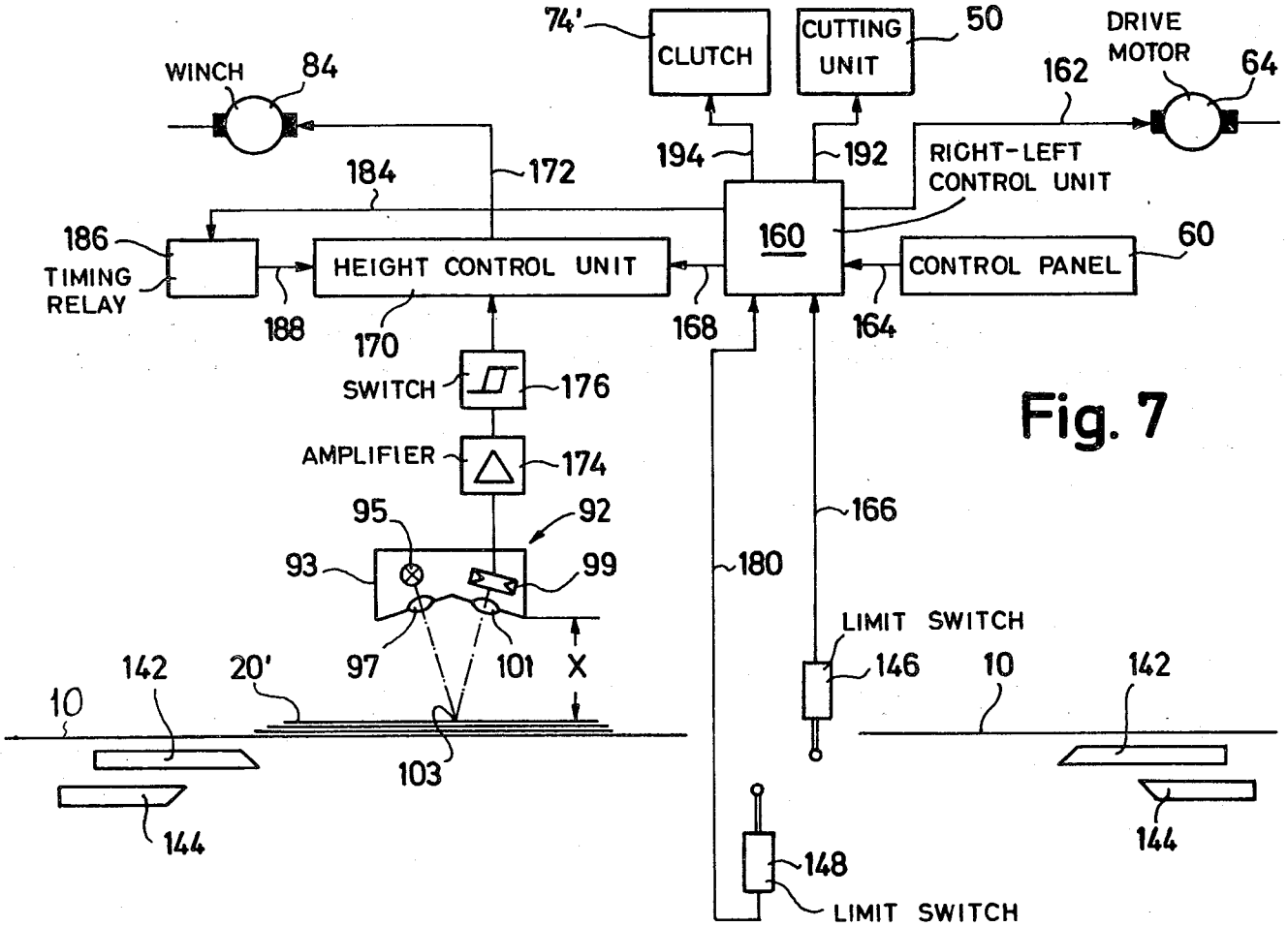
FIG. 7 is a block diagram of a control incorporated in the preferred embodiment.

Turning now to FIG. 7, in addition to parts of the laying table 10 with the control rails 142 and 144 at both ends of the laying table 10, there are illustrated the limit switches 146 and 148 of the laying carriage 12 between the two sets of control rails 142 and 144. It is to be unerstood that the distance of the two control rails 142 or the distance between the two control rails 144 has been shown shortened for the sake of illustration. On the laying table 10, there are shown a plurality of laid (superimposed) web layers, of which the top layer is—as it has been noted before—designated at 20'.

The reflected light sensor 92 will now be discussed in more detail in conjunction with FIG. 7.

In a housing 93 of the reflected light sensor 92 there are arranged a light source 95 with an associated optical system 97 as well as a photocell 99 with an associated optical system 101. The optical system 97 forms the image of the light source 95 at a monitored location 103 which is situated at a distance X underneath the reflected light sensor 92. The optical system 101, in turn, forms the image of the location 103 on the photocell 99. If now in the monitored location 103 there is situated a surface which does not completely absorb the light of the light source 95, the focussed image of the light source is determined by means of the photocell 99.

Expediently, the reflected light sensor 92 is so designed that the distance X is adjustable.

Figure 8:
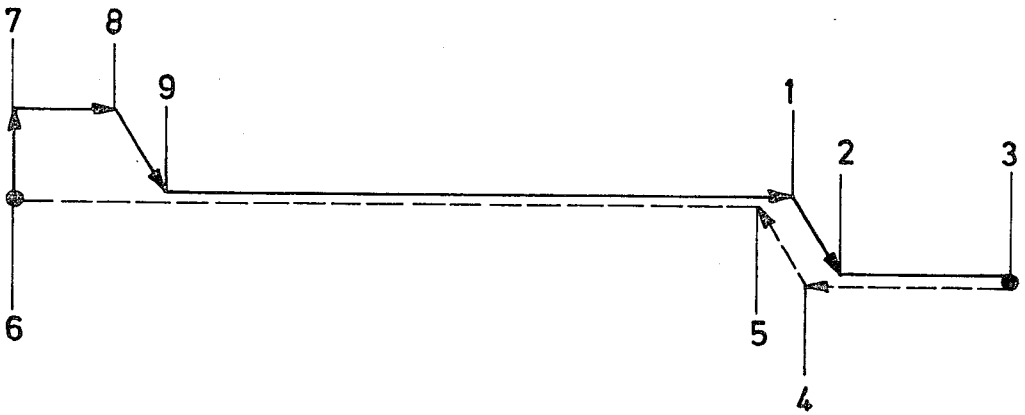
FIGS. 8 and 9 are diagrams illustrating the paths of motion in two different operational modes of the preferred embodiment.

In the description which follows, there will be set forth, with reference to FIGS. 7 and 8, a first mode of operation, designated as "simple web laying". In this description, reference will be made to the positions of the web laying unit 26, designated at 1 through 9 in FIG. 8.

It is assumed that prior to the commencement of the web laying process, the web laying unit 26 is situated in the middle between the two end positions of the laying carriage 12 and further, the web laying unit 26 is assumed to be at such a height position above the laying table 10 that the free edge of the lower guide face portion 38 (FIG. 2) of the web laying unit 26 is at a distance of a few centimeters from the upper face of the laying table 10. The control of the web laying machine illustrated as a block diagram in FIG. 7 is so designed that when the operating person turns on the laying machine at the control panel 60, the laying carriage 12 starts its travel towards the right as viewed in FIG. 8. For this purpose, the control includes a right-left control unit 160 which, by means of a conductor 162 controls the reversible drive motor 64 and which, in turn, can be controlled from the control panel 60 by means of a conductor 164.

When the laying carriage 12 approaches its right-hand end position, first the limit switch 146 runs up on, and is thus actuated by the control rail 142. The actuation of the limit switch 146 triggers the following events:

The limit switch 146 connected by a conductor 166 with the right-left control unit 160 causes the latter to switch over from a high-speed run of the motor 64 to a low-speed run. Further, by means of a conductor 168, a height control unit 170 is activated which causes, via a conductor 172, the reversible winch 84 to run in a sense of lowering the web laying unit 26 until the reflecting light sensor 92 senses the attainment of the preselected minimum distance X of the free edge of the lower guiding face part 38 of the web laying unit 26 above the upper surface of the laying table 10. Upon this occurrence, the reflected light sensor 92 applies, by means of an amplifier 174 and a switch 176, a signal to the height control unit 170 to de-energize the winch 84. The position in which the limit switch 146 runs up on, and is thus actuated by the control rail 142 is designated at 1 in FIG. 8, while the reference numeral 2 designates the position of the web laying unit 26 in which the reflected light sensor 92 causes a de-energization of the winch.

The laying carriage 12 then travels the path between the positions 2 and 3 with low-speed run until the limit switch 148 runs up on, and is thus actuated by the right-hand control rail 144, whereupon the limit switch 148, by means of a conductor 180, sends a command signal to the right-left control unit 160 to briefly arrest the drive motor 64 and to cause it to resume its rotation in the opposite direction with a low-speed run.

Figure 6:
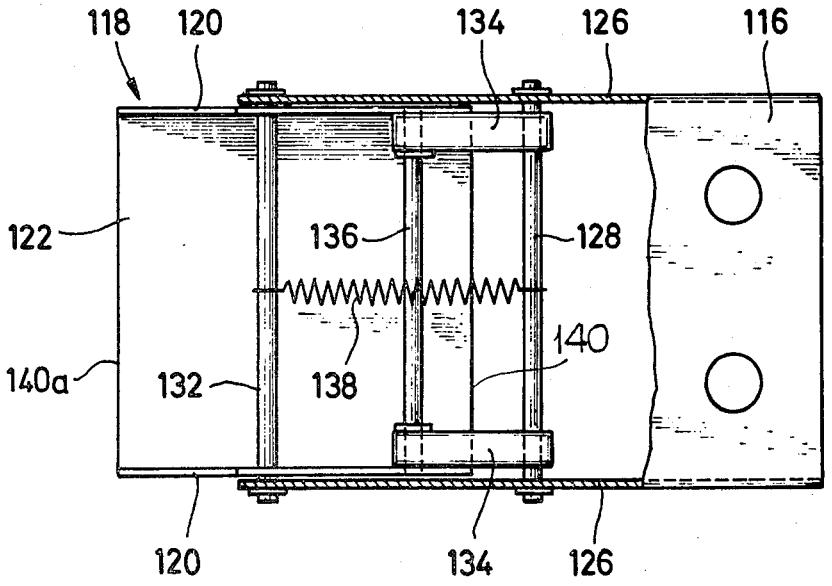
FIG. 6 is a sectional view taken along line 6—6 of FIG. 5.

Also referring to FIGS. 2, 5 and 6, during the travel between the positions 2 and 3, the control arms 114 of the web laying unit 26 lift the web grasping rail 102 of the right-hand web holding unit 94 to such an extent that in the right-hand terminal position of the web laying unit 26 the frontal zones of the web holding elements 118 are above the edge zone of the lower guide face part 38. If thereafter the laying carriage 12 is slightly moved towards the left and at the same time the web grasping rail 102 has started to drop by its own weight, the brush inserts 124 of the web holding elements 118 grasp those ends of the web which lie on the lower guide face part 38. Since the lower guide face part 38 is situated only slightly above the upper surface of the laying table 10, the web holding elements 118 lie, with their rear edge 140, in engagement with the surface of the laying table 10, that is, they assume their oblique position as shown in phantom lines in FIG. 5. During further travel of the laying carriage 12 towards the left, the web grasping rail 102 continues to drop, the web holding elements 118 fall back onto the laying table 10 whereupon, by virtue of the particular geometry of the linkage of the web holding elements 118, the web ends grasped by the brush inserts 124 execute no relative motion with respect to the laying table 10 and are immobilized on the surface of the laying table 10.

When, during the travel of the laying carriage 12 towards the left, the limit switch 146 has moved away from the control rail 142, the right-left control unit 160 switches the drive motor 64 over to the high-speed run and furthermore activates, by means of a conductor 184, a timing relay 186 which is connected with an input of the height control unit 170 by means of a conductor 188. The timing relay 186 allows the height control unit 170 to let the winch 84 run during the switching time of the timing relay 186 in the sense of raising the web laying unit 26 and, during this occurrence, the web laying unit 26 moves from the position 4 to the position 5 as indicated in FIG. 8.

After de-energization of the winch 84 by means of the timing relay 186 and the height control unit 170, the laying carriage 12 travels with high-speed run towards the left until the limit switch 146 has reached the left-hand control rail 142 and is actuated thereby. Thereupon the right-left control unit 160 switches the drive motor 64 from the high-speed run to the low-speed run. If the web laying machine is in the "simple laying" mode, the right-left control unit 160 prevents a lowering of the web laying unit 26 by an appropriate setting of the control panel 60. When the limit switch 148 reaches, in position 6 of FIG. 8, the left-hand control rail 144 and is actuated thereby, the right-left control unit 160 arrests the driving motor 64 for a short period and energizes the cutting unit 50 by means of a conductor 192. Thus, the cutting unit 50 is propelled along the web laying unit 26, while the cutting disc 52 rotates, whereby the deposited web layer is severed from the continuous web 20. At the same time, the right-left control unit 160 energizes the timing relay 186 and causes, by means of the timing relay 186 and the height control unit 170, the winch 84 to run in the sense of lifting the web laying unit 26, for the duration of the switching time of the timing relay 186. Further, the right-left control unit 160, after the timing relay 186 has run, causes the drive motor 64 to rotate again towards the right with low-speed run. During the standstill of the laying carriage 12 and the run of the winch 84, the web laying unit 26 moves from the position 6 to the position 7.

After the web laying unit has traveled from the position 7 to the position 8, the limit switch 146 moves off the left-hand control rail 142. This occurrence causes actuation of the limit switch 146 which thus causes, by means of the right-left control unit 160, a switchover of the drive motor 64 from the low-speed run to the high-speed run and further causes, by means of the timing relay 186 and the height control unit 170, the winch 84 to run in the sense of lowering the web laying unit 26, so that the latter moves from the position 8 into the position 9.

The right-left control unit 160 also controls, by means of a conductor 194, a clutch 74' which may be a component of the transmission gear 74 and which connects the take-off roll 22 to, and disconnects the same from the drive motor 64. In the "simple laying" mode of operation, the control is effected in such a manner that the take-off roll 22 is driven only when the laying carriage 12 moves from the position 3 to the position 6 to thus pull off web material from the supply reel 18. The transmission gear 74 has such a transmission ratio that the web take-off speed corresponds to the momentary traveling speed of the laying carriage 12. As the laying carriage 12 moves back from the left-hand terminal position into the right-hand terminal position, the take-off roll 22 is at a standstill.

As a result of the upward movement of the web laying unit 26 from the position 6 into the position 7, the lower guide face portion 38 of the web laying unit 26, when the laying carriage 12 starts its travel towards the right-hand terminal position, cannot fold over the just-cut terminal portion of the web layer deposited on the laying table 10.

By means of the right-left control unit 160, there is further controlled a drive (not shown) for the carrier shaft 42 of the clamping strip 44 of the web laying unit 26 in such a manner that the clamping strip 44 holds firmly that portion of the web 20 which lies on the lower guide portion 38 when the just-deposited web layer is cut by the cutting unit 50 and the laying carriage 12 travels from its left-hand terminal position into the right-hand terminal position without performing any web laying operation.

According to the invention, it is further feasible to replace the timing relay 186 by a second sensor and it is further feasible to set, by means of a sensor, the higher position of the web laying unit 26 which it assumes during travel between points 9 and 1 as compared to the height position which it assumes during travel between points 5 and 6. In such an arrangement the web laying unit 26 would be lowered by a timing relay during its travel from the position 1 into the position 2.

It is an essential feature of the method and the apparatus according to the invention that at the ends of the traveling path of the laying carriage the web to be laid by the web laying unit of the web laying machine need not be pulled down by the web holding devices over a substantial length onto the level of the laying table or, as the case may be, onto the uppermost, already-deposited layer, since the web laying unit, at the latest when it has reached its end position, has been lowered at least approximately to the above-noted height level. Further, during the greatest part of the path which the laying carriage travels while the web laying operation itself takes place, the web laying unit is at such a distance above the last-deposited web layer that there can be no collisions with upwardly bulging zones of the deposited web.

In the above-described preferred embodiment of the laying machine according to the invention, the sensor, designed in particular as a reflected light sensor, takes into consideration, layer to layer, the gradual growth of the thickness of the layer stack on the laying table 10 and thus ensures that the working height position (during web laying) and the transfer height position (during transfer of the web to the holding devices) are, from layer to layer corrected by the amount of the thickness of the web material.

In the description that follows, the operation of the laying machine according to the invention in the "zigzag laying" mode will be set forth with reference to FIGS. 7 and 9. The zigzag laying mode—which, similarly to other operational modes of the machine, is set at control panel 60—differs from the above-described simple laying mode in that a web layer is deposited by the web laying unit 26 on the laying table 10 in both directions of travel of the laying carriage 12.

It is noted at the outset in connection with the zigzag laying mode that the web laying unit shown in the drawings is to be replaced by one adapted for such zigzag laying and further, on the laying table 10, in the left-end terminal position of the laying carriage 12, a web holding unit identical to the web holding unit 94 should be arranged. Since web laying units adapted to perform zigzag laying are known—such units are disclosed, for example, in German Offenlegungsschrift (Laid-Open Application) No. 2,316,706 to which corresponds U.S. Pat. No. 3,677,536 which is hereby incorporated by reference—and since the general construction of the web laying unit is, by itself, not a part of the invention, such a zigzag web laying unit is neither illustrated nor described in detail. It is further noted that such a web laying unit differs from the above-described web laying unit 26 only in that its supplies web in both directions of motion of the laying carriage and is adapted to deposit web during such travels, wherein the length portion of the web taken off from the supply and leaving the web laying unit at all times trails the web laying unit; that is, relative to the momentary direction of motion of the laying carriage, the web is discharged at the rearward end of the web laying unit. Thus, there are provided two oppositely oriented guide face parts which correspond to the lower guide face part 38 of the web laying unit 26 and the zigzag web laying unit is so designed that in each traveling direction the web layer drawn from the web supply is placed at that guide face part which trails the laying carriage at that time. These guide face parts are conventionally structured as "web laying spades". Thus, these components are strips which extend transversely to the laying table 10 and which alternatingly—dependent upon the direction of travel—are swung up into an inoperative position, while in the one end position of the laying carriage 12, the then effective (working) strip lies between the two layers of a web length portion which has been folded back on itself.

Figure 9:
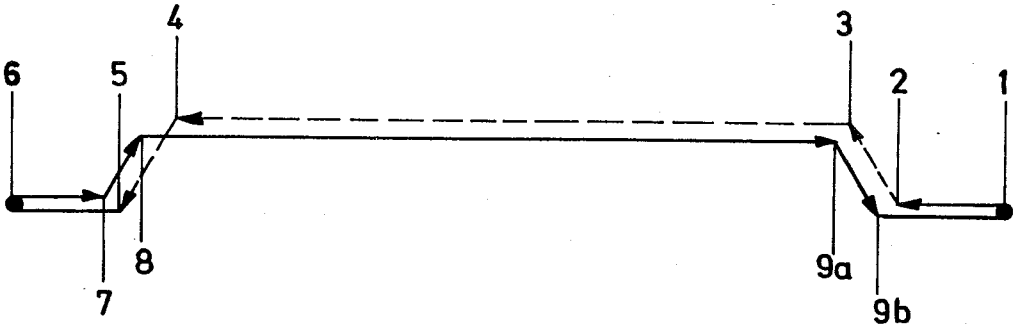

The right-hand portion of FIG. 9 corresponds entirely to the right-hand portion of FIG. 8 and further, the left-hand part of FIG. 9 is symmetrical to the right-hand part of this Figure, apart from those differences which arise from the fact that, upon reversal of the direction of travel, the working height of the web laying unit changes each time by an amount which corresponds to the thickness of one layer.

It is assumed that the web laying machine starts its web laying operation in position 1 of FIG. 9. If now the operator starts the operation of the web laying machine by giving an appropriate command signal at the control panel 60 with a setting in the zigzag mode, the right-left control unit 160 causes the drive motor 64 to rotate with low-speed run, so that the laying carriage 12 moves from the position 1 into the position 2 until the limit switch 146 moves away from the right-hand control rail 142. This results in a signal by the limit switch 146 to switch over the drive motor 64 by means of the right-left control unit 160 to the high-speed run and to raise the web laying unit from the position 2 to the position 3 as commanded by the timing relay 186. The clutch 74' is engaged so that the take-off roll 22 begins to draw web material from the supply reel 12 as the carriage 12 leaves the position 1.

As the limit switch 146 reaches the left-hand control rail 142 and is actuated thereby, the right-left control unit 160, triggered by the limit switch 146, switches the drive motor 64 from the high-speed run to the low-speed run and causes the web laying unit to be lowered by means of the winch 84 until the reflecting light sensor 92 responds. During the lowering of the web laying unit, the latter is displaced by the laying carriage 12 from the position 4 to the position 5.

Thereafter, the laying carriage 12 travels with low-speed run until it reaches the left-hand terminal position (position 6) which too, as noted above, is provided with a web holding unit 94 for the zigzag laying mode. Upon reaching the position 6, the limit switch 148 has run up the left-hand control rail 144 and is actuated thereby. Thereupon the right-left control unit 160 reverses the drive motor 64 into a right-hand rotation. In the zigzag laying mode, the transmission gear 74, including the clutch 74' is in a state which ensures that the take-off roll 22 is driven by the drive motor 64 always in the same direction, independently from the direction of rotation of the drive motor 64. That is, the take-off roll 22 rotates in the sense of drawing off the web material 20 from the web supply 18. Such drive means are known in web laying machines so that a detailed illustration and description thereof is not deemed to be necessary.

As the web laying unit reaches the position 7 from the position 6 with a low-speed run, the limit switch 146 leaves the left-hand control rail 142 and emits a signal whereby the right-left control unit 160 switches the drive motor 64 to the high-speed run and causes the web laying unit to be lifted by the winch 84 as commanded by the timing relay 186 (transition from the position 7 into the position 8).

Thereafter, the laying carriage 12 travels with high-speed run towards the right until the web laying unit has reached the position **9*a*, at which time the limit switch 146 has reached the right-hand control rail 142 and is actuated thereby. As a result, the right-left control unit 160 switches the drive motor 64 from the high-speed run to the low-speed run and the height control unit 170 is activated whereupon the latter causes rotation of the winch 84 to lower the web laying unit until the reflect light sensor 92 responds. During this time, the web laying unit has moved from the position 9*a* into the position 9*b* from which it moves with low-speed run to the right-hand terminal position 1. At that location, the limit switch 148 reaches the right-hand control rail 144 and thus switches the drive motor 64** from a right-hand travel to a left-hand travel.

In the pure zigzag laying mode, the right-left control unit 160 does not trigger the cutting unit 50 so that in each end position the web is folded back on itself and is immobilized by one of the two web holding units 94 arranged at either longitudinal end of the laying table 10.

It is to be understood that all the essential features, advantages and alternatives discussed in connection with the simple laying mode also apply in the zigzag laying mode.

By virtue of the particular articulation of the web holding elements, it is ensured that the cut edges of the web layers in the "simple laying" and further, the folded-over zones of the web in the "zigzag laying" are superimposed with great precision and are free from stresses. Further, the pivotal web holding elements well conform to the course of material.

In a known variant of the zigzag laying mode, the folded locations of the sheet are cut open. In this type of operation too, the advantages of the method and the laying machine according to the invention manifest themselves because by virtue of a precise superpositioning of the folds, loss of material during the severing operation can be significantly reduced as compared to prior art arrangements.

Figure 10:
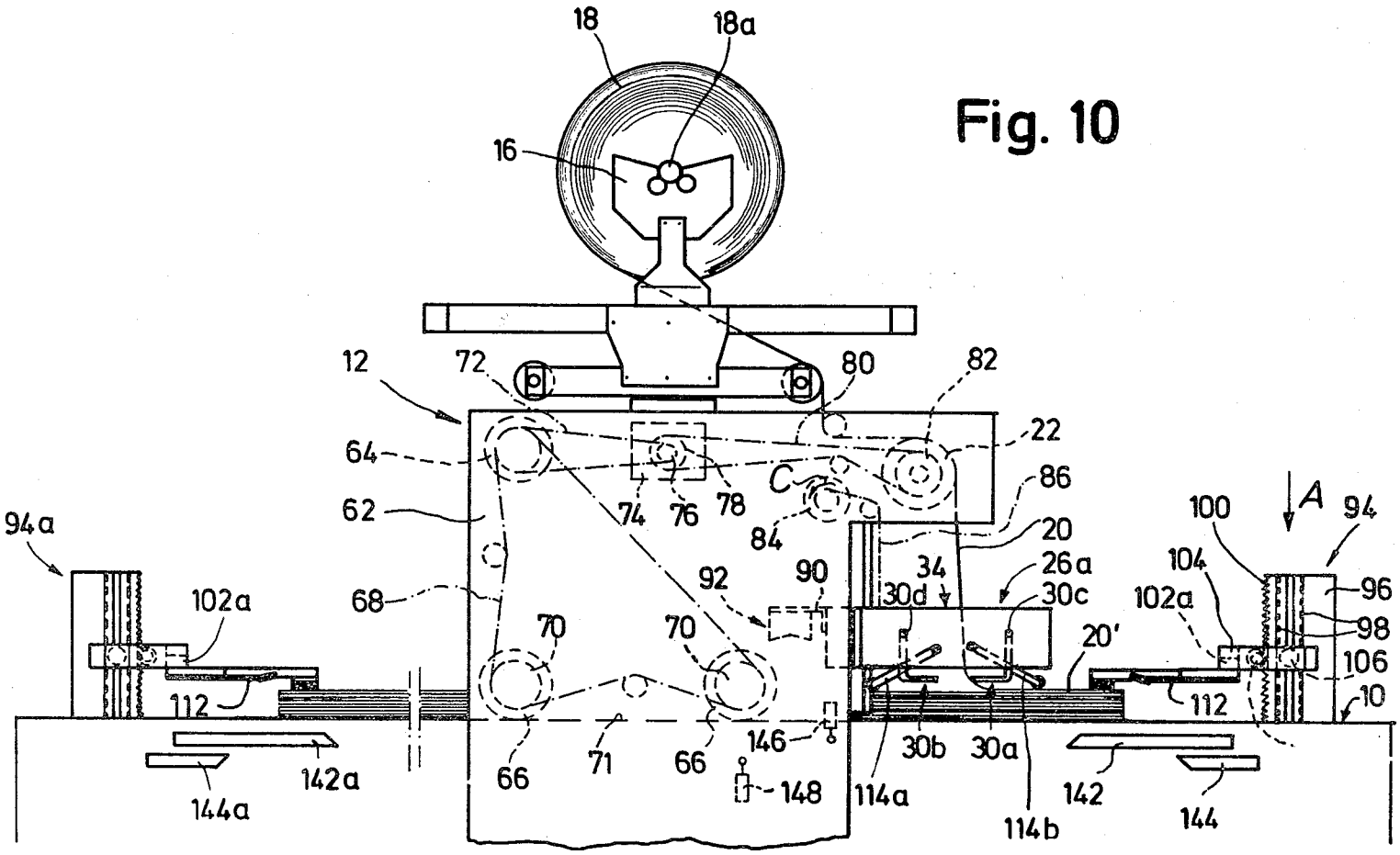
FIG. 10 is a schematic side elevation view similar to FIG. 2 showing, however, a modified version of a web laying machine incorporating a preferred embodiment of the invention for zigzag laying.
Figure 11:
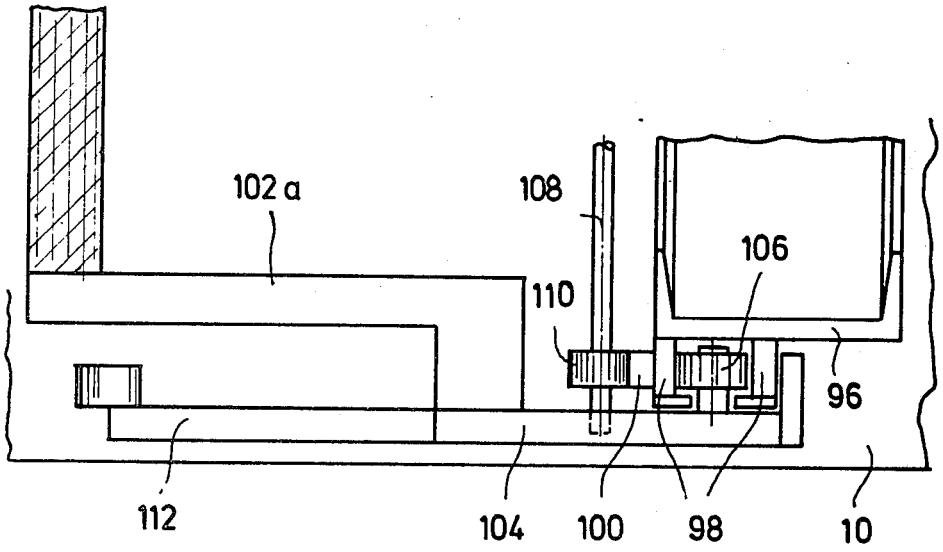
FIG. 11 is a top plan view of some of the components shown in FIG. 10 and corresponds to FIG. 3.
Figure 12:
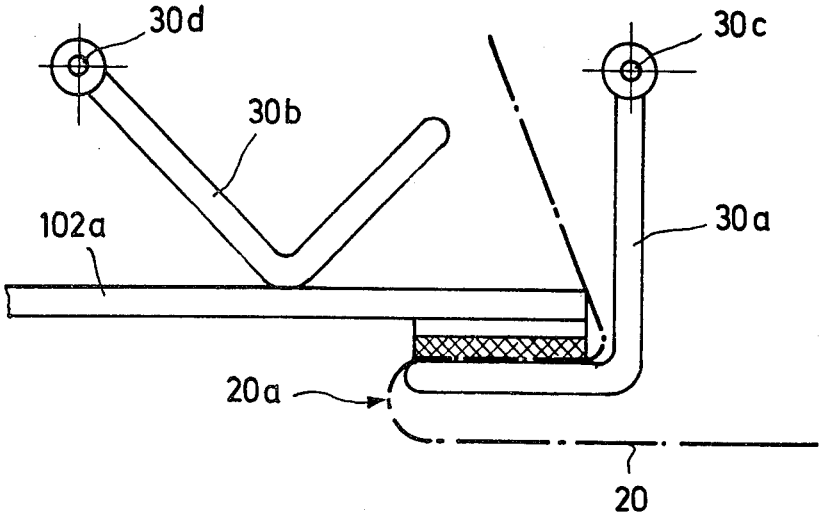
FIG. 12 is a side elevational view of some of the components shown in FIG. 10, however, in a different position.

Turning now to FIGS. 10 to 12 a version modified for zigzag laying will be described in the following. For these Figures the same reference numerals have been used as in FIGS. 2 and 3 as far as the same or similar elements are used as in the embodiment according to FIGS. 2 and 3, and only the modifications in the design, and the function of the laying machine will be briefly described.

As already mentioned, web holding units 94 and **94*a* as well as control rails 142, 144 and 142*a*, 144*a* are disposed at the right and the left end position of the laying carriage 12, and instead of the web grasping rail 102 suitable for the simple laying method in both units 94, 94*a* a slightly modified web grasping rail 102*a*** more suitable for the zigzag laying method is used.

Since in the zigzag laying method the web 20 is deposited during travel of the laying carriage in both directions, the take-off roll 22 is always driven in the same direction of rotation when the laying carriage moves which is achieved by using a transmission gear 74 well known in the art and driving its output shaft (shaft of sprocket 78) always in the same direction of rotation independant of the direction of rotation of sprocket 76.

The web laying unit **26*a*, instead of guide face 30 and angled sheet metal member 40 of web laying unit 26 of the first embodiment, comprises two so-called web laying spades 30*a* and 30*b* made of angled sheet metal disposed symmetrically and mounted pivotally between the side walls of the housing 34, so that they can be tilted relative to horizontal axes 30*c* and 30*d***.

When starting the zigzag laying the leading edge of the web 20 is inserted between the web laying spades **30*a* and 30*b* which are in their positions shown in FIG. 10. Then the laying carriage 12 is propelled to the left towards the web holding unit 94*a* thereby pulling the web 20 from the supply reel 18, deflecting the web by means of the laying spade 30*a* and depositing the web onto the laying table 10**.

When the laying carriage 12 approaches the web holding unit **94*a*, a control arm 114*a* corresponding to control arm 114 of the embodiment according to FIGS. 2 and 4 lifts the web grasping rail 102*a* of web holding unit 94*a* slightly above the level of the top surface of the horizontal leg of the laying spade 30*a*. When the laying carriage proceeds to approach the web holding unit 94*a* the web grasping rail 102*a* strikes against the vertical leg of the laying spade 30*b* thereby pivoting the same by ca. 90° to the right. If the laying carriage 12 then proceeds to its left end position, the left web grasping rail 102*a* is disposed above the horizontal leg of laying spade 30*a*; simultaneously, the front ends of the control arm 112 of the left web grasping rail 102*a* (see FIG. 11**)

have passed the upper, right-hand end of control arm 114*a*, so that the left web grasping rail 102*a* drops down onto the web 20 and the horizontal leg of laying spade 30*a* (see FIG. 12) thereby forming a fold 20*a* in the web.

Then the laying carriage 12 moves to the right, whereby the fold 20*a* is drawn from the laying spade 30*a* by means of the web grasping rail 102*a* which presses the web 20 against the laying table 10. When the laying carriage moves further to the right, the web grasping rail 102*a* releases the laying spade 30*b*, so that the latter returns to its position shown in FIG. 10. Thereafter, the web pulled from the supply reel 18 abuts against the laying spade 30*b* and is deflected to the horizontal before being laid down onto the preceding web layer.

When the laying carriage 12 approaches the right web holding unit 94, the operation of the web laying machine corresponds to the operation previously described in connection with the left web holding unit 94*a*.

As already mentioned above in connection with FIG. 7, the elements, units and modules of the control may be of conventional design and thus a person of ordinary skill in the field of electronic control means would readily known how to design such a control system on the basis of the previously given operation. E.g., a PC-control system comprising microprocessors, memories, decoders, a calculator etc. like the PC-control system offerey by ITT under the name "ITT Director" can be used for achieving the described operation. Nevertheless, in the following, the production and use of the control signals related to the control panel 60, the right-left control unit 160 and the height control unit 170 will be described in connection with FIGS. 13 to 16C showing schematic circuit diagrams of these units when being designed as relay systems.

Figure 13:
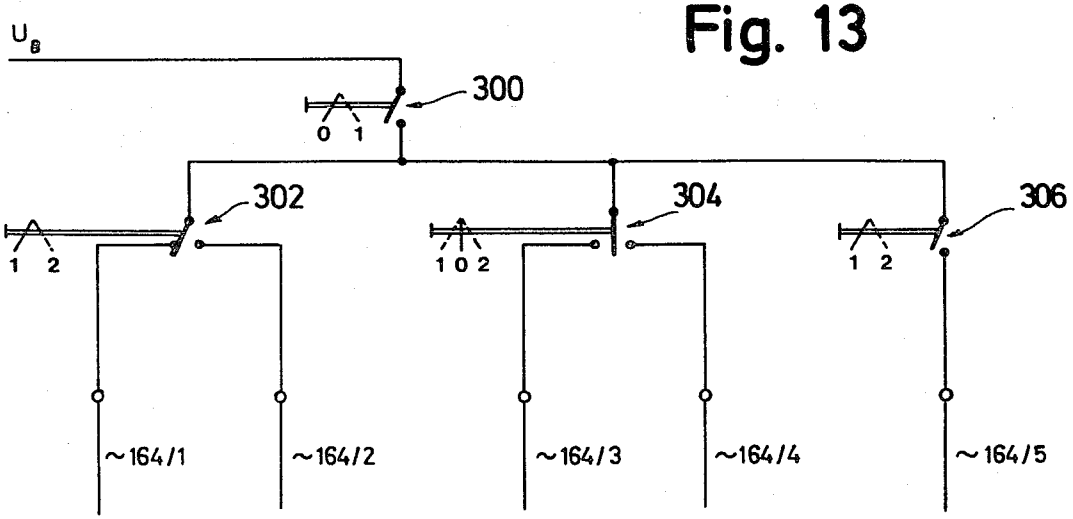
FIG. 13 is a block diagram of an embodiment of the control panel shown in FIG. 7.

FIG. 13 shows the circuit of the control panel 60 with a line $U_B$ for the operating voltage, an on-out-switch 300, an operation mode switch 302, a travel direction switch 304, a laying mode switch 306, and output lines 164/1, 164/2, 164/3, 164/4, 164/5. When switch 302 is in its position "1", the control system is open to manual control, whereas in the position "2" automatic control takes place. When switch 304 is brought into its position "0", the laying carriage 12 is stopped, in position "1" the laying carriage is driven to the left, in position "2" the laying carriage is driven to the right. When switch 306 is brought into its position "1" the simple laying method takes place, whereas position "2" causes zigzag laying.

Figures 14A, 14B, 14C:
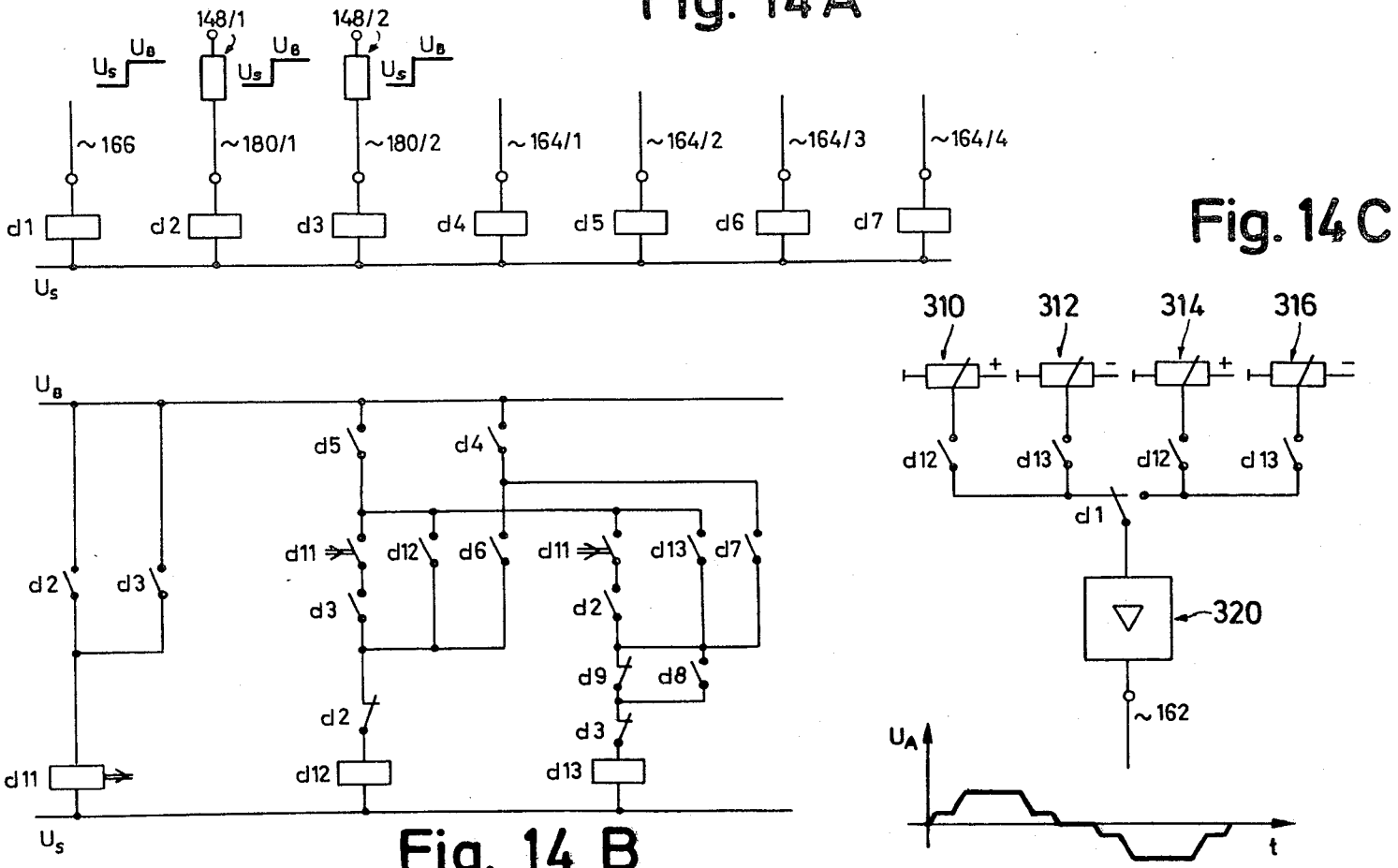
FIGS. 14A, 14B, 14C, 15A, and 15B show block diagrams of several portions of an embodiment of the right-left control unit shown in FIG. 7.
Figure 15A:
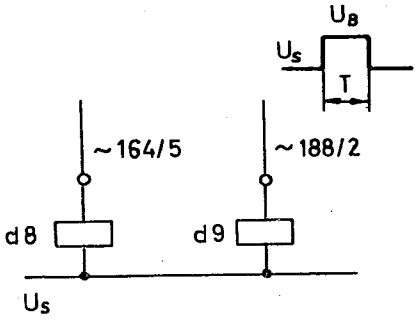
Figure 15B:
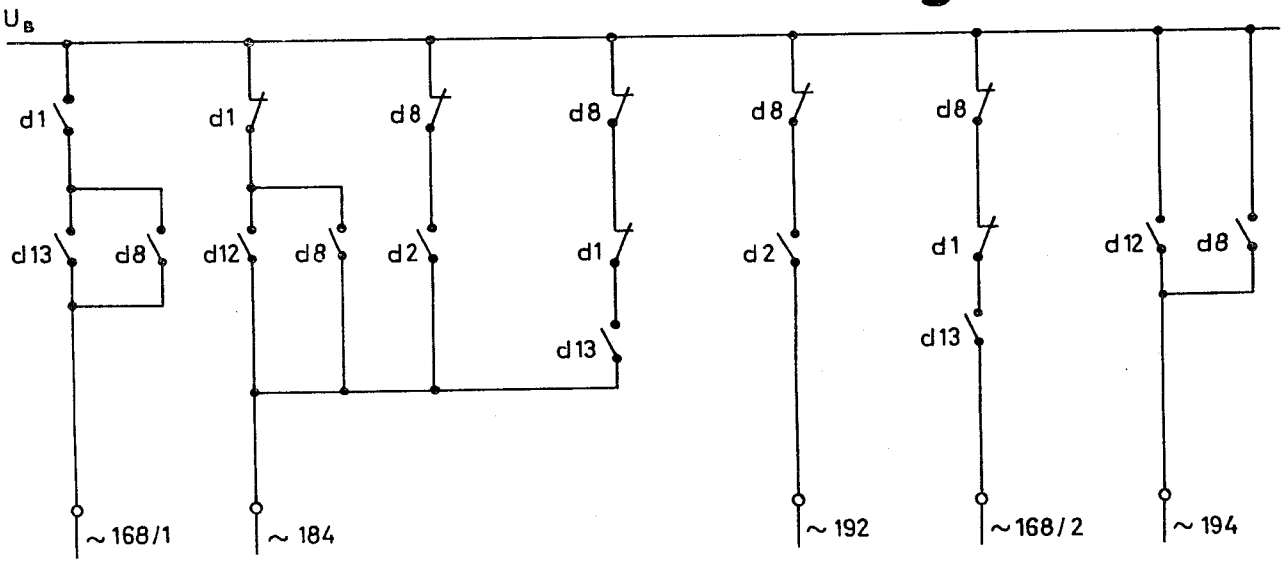

FIGS. 14A, 14B, and 14C show substantially that portion of right-left control unit 160 controlling the drive motor 64, whereas FIGS. 15A and 15B show substantially that portion of right-left control unit 160 controlling other units like cutting unit 50 and clutch 74'. In these drawings the same symbols (eg. d 4) have been used for the coils and the contacts of the relays.

FIGS. 14A and 15A show an input lines the output lines 164/1 to 164/5 of FIG. 13 as well as the output line 166 of limit switch 146 (see FIG. 7), the output line 180/1 of a left limit switch 148/1, the output line 180/2 of a right limit switch 148/2 (for zigzag laying two limit switches are necessary instead of a single limit switch 148 shown in FIG. 7), and a second output line 188/2 of timing relay 186 not shown in FIG. 7 for stopping drive motor 64 during rise from position "6" to position "7" (see FIG. 8). Besides output lines 166, 180/1 and 180/2 the output signals are indicated—the voltage on those lines is switched from a ground voltage $U_S$ to the operating voltage $U_B$.

Moreover, FIGS. 14A to 15B show eleven control relays d 1 to d 9 as well as d 12 and d 13, and in addition a timing relay d 11, four potentiometers 310, 312, 314, 316 for setting nominal values for the laying carriage speed (relay 310 for high-speed to the left, relay 312 for high-speed to the right, relay 314 for low-speed to the left, and relay 316 for low-speed to the right), and a usual control unit 320 for the drive motor 64. The output voltage of control unit 320 is shown in the adjacent diagram. The timing relay d 11 is used for controlling the short stop interval of the laying carriage 12 in its left hand and right hand end positions.

The output lines of the right-left control unit 160 shown in FIG. 15B are the following:

Output lines 168/1 and 168/2 are parts of the multichannel line 168 shown in FIG. 7 and provide input lines for the height control unit 170 shown in FIG. 16A, whereas lines 184, 192, and 194 are shown in FIG. 7.

The relays d 12, d 13 select the nominal values for the corresponding direction during the operation mode "automatic" via the limit switches (relays d 3, d 2) and the timng relay 186 (relay d 9), and during the operation mode "manual" (relay d 4) via the travel direction switch 304 (relays d 6, d 7).

Therefore, the timing relay 186, on the one hand, controls the height control unit 170 via line 188/1, and, on the other hand, controls the right-left control unit 160 via line 188/2. The limit switch 146 (relay d 1) controls the change-over to the nominal value for the low-speed.

The signals on the lines 192 and 194 for the cutting unit 50 and the clutch 74' are produced in dependence from the operation time (relay d 8).

The signals "down" on line 168/1 and "up" on line 184 for the height control unit 170 are produced in dependence from the operation mode (relay d 8). The timing relay 186 is used once also for lowering the web laying unit 26, and the signal on line 168/2 is used for switching over.

The circuitry of the height control unit 170 shown in FIGS. 16A, 16B, and 16C is provided with input lines 168/1 and 168/2 (two of the output lines in FIG. 15B), 188/1 (one of the output lines of timing relay 186, namely the one shown in FIG. 7), and 176/1 (output line of switch 176). Moreover, the circuitry comprises six control relays d 1, d2, d 3, d4, d11 and d 12, two potentiometers 340 and 342 for setting the nominal values for the lowering and lifting speed, respectively, of the web laying unit 26, and a usual control unit 344 for the motor of the electric winch 84. The output voltage of control unit 344 is shown in the diagram adjacent FIG. 16C, whereas the signal voltages on lines 188/1 and 176/1 are indicated adjacent these lines in FIG. 16A.

Relay d 11 starts the lowering of web laying unit 26, whereas relay d 12 starts the lifting of said unit. The downward movement is stopped under control of sensor 92 (relay d 3), whereas the upward movement is stopped by timing relay 186 (relay d 2).

However in the operation mode "simple laying method" lowering of the web laying unit 26 is started and stopped by timing relay 186 when the laying carriage 12 leaves the left hand control rail 142. The switching over to this function is achieved by relay d 4.

It will be understood that the above description of the present invention is susceptible to various modifications, changes and adaptations, and the same are intended to be comprehended within the meaning and range of equivalents of the appended claims.

What is claimed is:

1. In a method of laying a web in superposed layers by a web laying machine on a laying table; the method including the steps of moving a laying carriage back and forth along the length of the laying table between first and second end positions; pulling a web from a web supply and laying a web length on the laying table at least during the travel of said laying carriage from said first end position to said second end position by a web laying unit mounted on the laying carriage; immobilizing the web by a web holding unit arranged at the first end position while the laying carriage moves from the first end position to the second end position; the improvement comprising the steps of maintaining said web laying unit, during a substantial part of the travel of the laying carriage between the two end positions, at a first laying height above the laying table; and, as said laying carriage approaches said first end position, lowering said web laying unit to a second laying height when said carriage reaches a predetermined location in a zone of said first end position, whereby said laying unit is in said second laying height when said carriage is in said first end position; said second laying height being lower than said first laying height and being at least approximately at a level of the precedingly deposited web layer or, in the absence thereof, at a level of said laying table.

2. A method as defined in claim 1, wherein said lowering step is performed while said laying carriage travels towards said web holding unit.

3. A method as defined in claim 1, wherein the step of laying is performed solely during the travel of said laying carriage from said first end position to said second end position; further comprising the steps of severing just-deposited web layers when the laying carriage has reached said second end position; and raising said web laying unit after said severing step and before said laying carriage starts its travel from said second end position towards said first end position.

4. A method as defined in claim 3, wherein said web laying unit is raised during said raising step to a height level which said laying height; further comprising the step of lowering said web laying unit to said laying height at a distance from said second end position subsequent to said raising step.

5. A method as defined in claim 1, wherein laying of web lengths is performed during the travel of said laying carriage from either end position to the other, and further wherein a separate web holding unit is disposed in both said end positions; further comprising the step of lowering said web laying unit from said laying height at least approximately to a height level of the precedingly deposited web layer or, in the absence thereof, to a height level of said laying table, at the latest when said laying carriage reaches said second end position.

6. In a web laying machine including a laying table; a laying carriage arranged for back-and-forth travel along the laying table; drive means for propelling the laying carriage; limit switch means operatively connected to said drive means for determining first and second end positions of said laying carriage; means for supporting a web supply; web pulling means mounted on said carriage for drawing web lengths from the web supply; a web laying unit mounted on said laying carriage for laying web, pulled from the web supply, on the laying table at least during the travel of said laying carriage from said first end position to said second end position; means supporting said web laying unit for reciprocating motion towards and away from the laying table perpendicularly thereto; a winch means mounted on said laying carriage and operatively connected to said web laying unit for raising and lowering said web laying unit with respect to said laying table; and a web holding unit arranged at least in said first end position for grasping and immobilizing the web while said web laying unit deposits a web length on said laying table; the improvement comprising height control means mounted on said laying carriage and being operatively connected to said limit switch means and said winch means for raising and lowering said web laying unit as a function of the momentary location of said laying carriage with respect to said end positions; said height control means including height sensing means for responding to a first height position of said web laying unit above a web layer deposited last or, in the absence thereof, above said laying table; said height control means further including height switching means for setting a second height position of said web laying unit above the deposited web layer or, in the absence thereof, above said laying table; said first and second height positions being at different height levels, in a height position which is at a lower height level of said different height levels, said web laying unit being situated at least approximately at the level of a web layer precedingly deposited on said laying table or, in the absence of a precedingly deposited layer, at least approximately at the level of said laying table; said limit switch means including a first control element means for actuating said limit switch means shortly before said laying carriage reaches said first end position and a second control element means for actuating said limit switch means when said laying carriage reaches said first end position; said first control element means being operatively connected to said height control means for lowering said web laying unit shortly before said laying carriage reaches said first end position.

7. A web laying machine as defined in claim 6, wherein said height switching means comprises a timing relay means operatively connected with said winch means for setting a predetermined height difference between said first and second height position.

8. A web laying machine as defined in claim 6, further comprising power means for driving said web pulling means and clutch means for force-transmittingly connecting said power means to, or disconnecting said power means from said web pulling means, said clutch means being operatively connected to said limit switch means.

9. A web laying machine as defined in claim 6, wherein said height sensing means includes a proximity switch for responding without mechanical contacting to a predetermined distance between said proximity switch and said last deposited web layer or, in the absence thereof, said laying table.

10. A web laying machine as defined in claim 9, wherein said sensor is a reflected light sensor.

11. A web laying machine as defined in claim 10, wherein said reflected light sensor is mounted on said web laying unit and comprises a light emitting means directing a light beam towards said laying table and light receiving means oriented towards said laying table for receiving reflected light therefrom.

12. A web laying machine as defined in claim 6, wherein said second control element means is operatively connected to said drive means for controlling the travel of said laying carriage.

13. A web laying machine as defined in claim 6, wherein said web holding unit includes (a) a web holding element having an underside for engagement with the web; said underside having a first and a second edge extending transversely to a length dimension of said laying table, said first edge and said second edge being a rear edge and a front edge, respectively, as viewed from said laying carriage;

(b) means for positioning said web holding element onto a web portion which has left said web laying unit and which is situated on said laying table in the zone of said first end position;

(c) means for supporting said web holding element for pivotal motion at least approximately about said rear edge onto the web for effecting engagement between the web and said underside; and (d) pressing means for pressing said web holding element against said laying table for firmly holding the web thereagainst.

14. A web laying machine as defined in claim 13, wherein said web holding unit further comprises (e) rail means pivotally supporting said web holding element, said rail means forming part of said pressing means; and (f) spring means urging said web holding element into an oblique position in which said rear edge is closer to said laying table than said front edge.

15. A web laying machine as defined in claim 14, wherein said means for supporting said web holding element comprises first, second and third pivot axes extending transversely to the length dimension of said laying table; said second pivot axis being closest to said laying carriage among said pivot axes; said second pivot axis being defined by a second pivot member passing through said web holding element and being mounted on said rail means for displacement with respect to said rail means in a direction parallel to the traveling direction of said laying carriage; said third pivot axis being defined by a third pivot member mounted on said web holding element at a distance from said second pivot axis; said first pivot axis being defined by a first pivot member mounted on said rail means above and behind said third pivot axis as viewed in a generally horizontal direction from said laying carriage; said means for supporting said web holding element further comprising linkage means connecting said third pivot member with said first pivot member.

16. A web laying machine as defined in claim 15, wherein said spring means is a tension spring having first and second ends attached, respectively, to said first and second pivot member.

* * * * *